US012000249B2

(12) United States Patent
Ferreira da Silva et al.

(10) Patent No.: US 12,000,249 B2
(45) Date of Patent: Jun. 4, 2024

(54) METHOD OF REMOTE DIVERGENCE FOR WELLS EQUIPPED WITH INTELLIGENT COMPLETION

(71) Applicant: Petróleo Brasileiro S.A.—Petrobras, Rio de Janeiro (BR)

(72) Inventors: Mario Germino Ferreira da Silva, Rio de Janeiro (BR); Francisca Ferreira do Rosario, Rio de Janeiro (BR); Alexandre Zacarias Ignacio Pereira, Rio de Janeiro (BR); Rosane Alves Fontes, Petrópolis (BR); Maylton Freitas da Silva, Rio de Janeiro (BR); Rita de Cassia Comis Wagner, Niterói (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 76 days.

(21) Appl. No.: 17/835,629

(22) Filed: Jun. 8, 2022

(65) Prior Publication Data

US 2022/0389797 A1 Dec. 8, 2022

(30) Foreign Application Priority Data

Jun. 8, 2021 (BR) ..... 10 2021 011086 4

(51) Int. Cl.
*E21B 43/14* (2006.01)
*E21B 37/06* (2006.01)
*E21B 43/12* (2006.01)

(52) U.S. Cl.
CPC ..... *E21B 43/14* (2013.01); *E21B 37/06* (2013.01); *E21B 43/12* (2013.01)

(58) Field of Classification Search
CPC ..... E21B 43/14; E21B 43/12; E21B 37/06
See application file for complete search history.

(56) References Cited

U.S. PATENT DOCUMENTS 10,012,057 B2 * 7/2018 Panamarathupalayam ..... C09K 8/36
11,535,794 B1 * 12/2022 Abdulrazzaq ..... C09K 8/74

FOREIGN PATENT DOCUMENTS

BR 112017001305 A2 11/2017

OTHER PUBLICATIONS

Da Fonseca, T.C. (2012) "Integrity Analysis Methodology for Production Development Well Designs", Dissertation (Masters in Petroleum Science and Engineering ), UNICAMP, Campinas, SP.
Oliveira, N.E. (2019) "Assessment of the Use of Intelligent Completion in Carbonate Reservoir", Final Term Paper (Graduate in Petroleum Engineering, USP, Sao Paulo., 41 pages.

* cited by examiner

*Primary Examiner* — Catherine Loikith
(74) *Attorney, Agent, or Firm* — Mintz, Levin, Cohn, Ferris, Glovsky and Popeo, P.C.

(57) ABSTRACT

A system and method for inhibiting or removing scaling in wells equipped with intelligent completion (IC), including sealing failures, includes a mixture of viscous gel and solid material in different granulometries is used and spheres soluble in water and in oil. The system and method aim to maintain production of wells equipped with intelligent completion and aim to reduce costs in relation to operations commonly performed with rigs.

8 Claims, 2 Drawing Sheets

METHOD OF REMOTE DIVERGENCE FOR WELLS EQUIPPED WITH INTELLIGENT COMPLETION

CROSS-REFERENCE TO RELATED APPLICATION

This application claims priority to Brazilian Application No. 10 2021 011086 4, filed on Jun. 8, 2021, and entitled "METHOD OF REMOTE DIVERGENCE FOR WELLS EQUIPPED WITH INTELLIGENT COMPLETION," the disclosure of which is incorporated herein by reference in its entirety.

FIELD OF THE INVENTION

The present invention addresses to a remote treatment method with divergence in operations to inhibit or remove scale in oil producing wells equipped with intelligent completion (IC)

DESCRIPTION OF THE STATE OF THE ART

Processes related to the management of reservoirs by means of the control of production losses from oil wells basically involve two types of operations: chemical inhibition of the reservoir by means of the squeeze of a chemical inhibitor, which is absorbed by the rock and later gradually released into the water produced by the well, and the removal of scale from the reservoir and also in the pieces of equipment of the production system such as strings, WCT, manifolds, production lines, production risers, and even surface pieces of equipment of the Stationary Production Unit (SPU).

However, the difficulties found in these processes are mainly in the need to repeat such operations periodically. In the case of squeeze, due to the useful life of the treatment; in the case of scale removal, due to the renewal of scale formation in the equipment after a certain time interval. Carrying out these operations depends on the availability of critical resources, such as rigs and stimulation vessels, and involves financial issues, given the costs associated with loss of production in the well due to the need to close the same to carry out the operations.

The occurrence of failures in the operation of ICVs (inflow control valves), intelligent completion valves installed in the production string and that control the production of different production intervals of the reservoir, or other devices, such as the plugs that are used to plug the end of the production string, lead to a loss of selectivity relative to intervals of the reservoir. Selectivity is necessary to ensure that chemical treatments are directed to the interval of interest of the reservoir, in order to obtain the best efficiency in the result of the operations of scale inhibition or removal.

The proposal of this invention comprises a method of remote intervention with divergence to inhibit or remove scaling in wells equipped with intelligent completion, and can also be applied in cases of sealing failures or losses of tightness, with the purpose of overcoming the loss of selectivity of the well.

The document by Da Fonseca, T. C. (2012) "Integrity analysis methodology for production development well designs", Dissertation (Masters in Petroleum Science and Engineering), UNICAMP, Campinas, SP, discloses integrity studies of completed oil wells, for the prevention of uncontrolled flows from the well to the environment. This study identifies the failure modes of barriers and leakage paths, which may be failures in closing, leakage in the closed position, external leakage, internal leakage, leakage from the string to the annulus, exemplifying a production of two zones, with remote selectivity (intelligent completion), chemical injection and dedicated monitoring in each zone, safety valve and gas lift chuck. The document, however, does not disclose a method of remote intervention with divergence for inhibition or removal of scaling in wells equipped with intelligent completion, and further can be applied in cases of sealing failures or loss of tightness, such as the present invention.

The reference by Oliveira, N. E. (2019) "Assessment of the use of intelligent completion in a carbonate reservoir", Final Term Paper (Graduate in Petroleum Engineering), 41 pages, USP, São Paulo, addresses to an assessment, by means of simulations, of the use of intelligent completions in a carbonate reservoir model. The document discloses four possible cases to compare the effect of using intelligent completion on field production, with an optimization process being carried out by varying the parameters corresponding to the operational limits of a five-spot model. The document, however, does not disclose a remote method with divergence for maintaining the production of wells with intelligent completion, especially in cases where components have sealing failures or loss of tightness, such as the present invention.

Document BR112017001305 discloses an intelligent completion (IC) package arranged in each production zone of a well, a chemical injection system arranged and configured to inject a chemical into a selected production zone, by means of the use of an injection line and an injection mandrel, an IC control module configured to control each of the IC packages, and a supervision system configured to obtain measurement data from each bottomhole sensor in such a way to determine a margin for inorganic scale formation in each production zone using the measurement data, and to send commands to the chemical injection system and IC control module to prevent scale formation within the zone of production. Unlike the present invention, the document does not disclose The document, however, does not disclose a method for maintaining the production of wells with intelligent completion, in the scenario of occurrence of loss of selectivity of intelligent completion or equipment failure resulting, for example, in in loss of tightness of the production string.

Although documents of the State of the Art present remote operations in wells equipped with intelligent completion, they do not disclose a remote divergence method for maintaining the production of wells equipped with intelligent completion with sealing failures or losses of tightness. The present invention aims at establishing a method for remotely performing divergence operations in wells equipped with intelligent completion; that is, by means of the production unit with the use of a stimulation vessel and a few pieces of equipment on the production platform (SPU).

The invention has the advantage of reducing costs in the management of scaling, due to the use of remote interventions in wells, instead of operations with a rig. The cost is significantly lower than the use of a completion rig for the intervention to carry out the conventional squeeze or the removal of scale by acidification. In addition, remote operations reduce associated risks compared to rig operations.

BRIEF DESCRIPTION OF THE INVENTION

The present invention addresses to a remote divergence method for wells equipped with intelligent completion, which can be applied in cases of sealing failures or losses of tightness, wherein, for this purpose, there is used a mixture of viscous gel, calcite (calcium carbonate) of different granulometries, and water- and oil-soluble spheres.

This invention can be applied in the field of Reservoirs, in the management of scaling, and in the field of Lifting and Flow, in ensuring the flow of production from the wells. In addition, the technology can be applied to remote well intervention in the productivity restoration phase, by means of reservoir acidification operations, as well as scale inhibitor squeeze operations. And further, in the scenario of occurrence of loss of selectivity of intelligent completion, or equipment failure resulting in loss of tightness.

BRIEF DESCRIPTION OF DRAWINGS

The present invention will be described in more detail below, with reference to the attached figures, which, in a schematic form and not limiting the inventive scope, represent examples of its embodiment. In the drawings, there are.

DETAILED DESCRIPTION OF THE INVENTION

Figure 1:
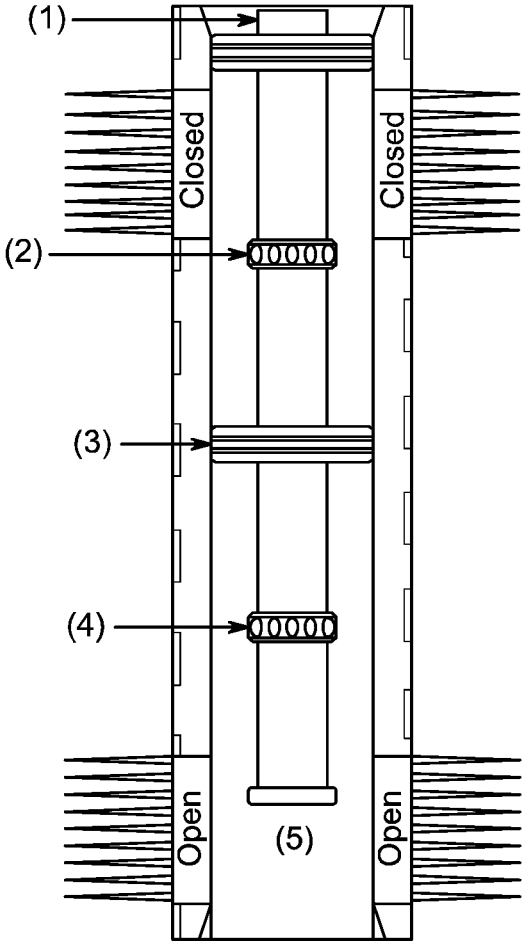
FIG. 1 illustrating a scheme of the production string showing the upper producing interval and the lower producing interval, where there are represented: the production string (1), the upper ICV (2), the packer (3), the lower ICV (4) and the plug (5)
Figure 2:
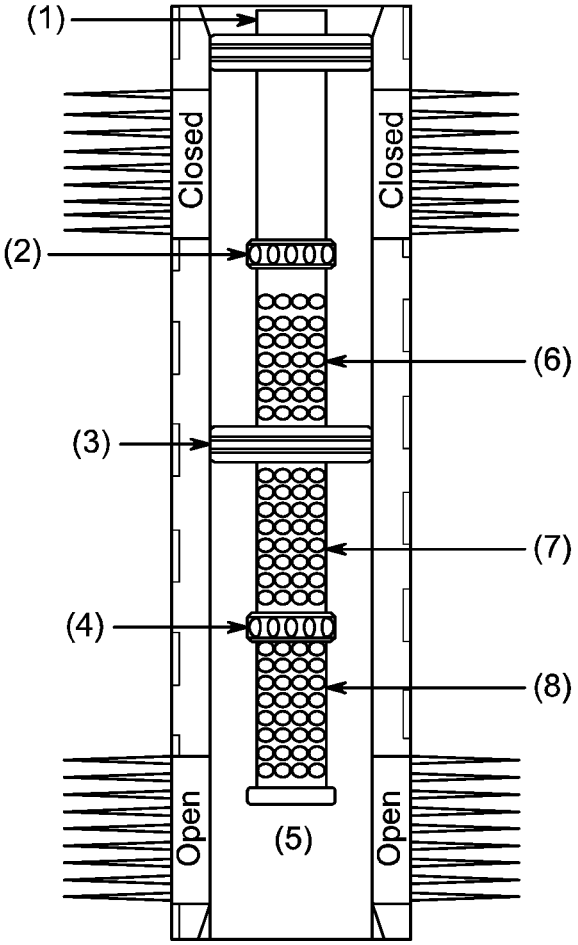
FIG. 2 illustrating the application of packing inside the string of oil-soluble sealant spheres, cross-linked viscous gel, solid material, and water-soluble sealant spheres, to reduce permeability and generate divergence within the production string, in order to direct the chemical treatment for the upper interval, where there are represented: the production string (1), the upper ICV (2), the packer (3), the lower ICV (4), the plug (5), the oil-soluble spheres (6), the cross-linked viscous gel and solid material (7), the water-soluble sealing spheres (8).

The remote divergence method for wells equipped with intelligent completion, object of the present invention, occurs with the use of a mixture of viscous, mineral gel, such as calcite (calcium carbonate) of different granulometries, and water- and oil-soluble spheres.

The combination of these three materials is carried out as follows: a cylinder of porous medium is assembled inside the production string, with the spheres providing a main structure, while the solid material fills the voids between the spheres and the viscous gel fills the voids between the grains of solid material, as well as between them and the spheres and the string wall. In the pumping sequence, the water-soluble spheres (8) will be firstly pumped. Then, the mixture of cross-linked viscous gel and solid material (7) will be pumped, and finally the oil-soluble spheres (6) will be pumped. This sequence of positioning the spheres in the formation of the porous medium cylinder is intended to protect the cylinder during the acidification operation. At the lower part of the cylinder, due to contact with the oil in the well, there will be the water-soluble spheres (8). At the upper part of the cylinder, due to contact with acid treatment or chelating solutions, there will be oil-soluble spheres (6), naturally insoluble in water-based solutions.

In this way, there is a porous medium of low permeability by means of the mixture of soluble sealing spheres, solid material, such as calcite, in different granulometries, all these materials being involved in a high viscosity gel. The use of a mixture of soluble sealant spheres, viscous gel, and solid material to reduce permeability is presented as a robust technique to accomplish the divergence in the chemical treatment for inhibition or removal of scale in offshore oil producing wells equipped with intelligent completion.

Counteracting the loss of circulation is an operation used during the drilling and completion of oil wells in carbonate formations, as in the case of pre-salt, and sandstone formations. These operations generally use a mixture of chemical materials, such as viscous gels based on polymers and a material to cause plugging into the reservoir, such as calcite with different granulometries, and in this way generate a control of the loss of fluids to the formation.

The sealing spheres are used to promote divergence in wells with large extensions of perforations, when chemical treatments are required. These spheres are injected during the treatment, aiming at plugging the region that has the best permeability. The spheres are positioned in the hole of the perforation in the wall of the production casing, generating a blockage to the flow, which is diverted to other perforations where the injection flow was lower, and, therefore, the treatment is directed to the region that has less permeability, thus leading to the divergence of the treatment.

In the construction of the well, in the phase of equipping the well for production during the completion operations, completion pieces of equipment are installed in the well, such as the production string. Firstly, the production tail is lowered and then the packer is seated. Sometimes, after the lower well completion phase, the well is temporarily abandoned. Then, the stand valve is placed on top of the TSR (Tubing Seal Receptacle) mandrel, and then a plug of solid material, such as calcite, is placed inside the annulus over the tail, to protect the equipment at the top of the tail. Then, two cement plugs are built, in specific positions inside the annulus. When it is time to install the top completion, the two cement plugs are then removed. After fluid change and well cleaning, the solid material is removed from inside the annulus over the TSR mandrel.

The remote divergence method for wells equipped with intelligent completion, according to the present invention, is illustrated in one of its applications, but not limited to the same, in FIG. 1, comprising the following steps:

a) With the upper ICV (2) and lower ICV (4) closed, pumping the oil-soluble spheres (6), a mixture of viscous gel and solid material in different granulometries (7), and water-soluble spheres (8). Positing the cushion inside the production string (1). The cushion must have the volume ((6)+(7)+(8)) equivalent to the space between the plug (5) and the base of the intelligent completion valve of the upper interval;

b) Filling the production string (1) to the position above the lower interval ICV (4) and below the base of the upper ICV (2), positioning the water-soluble spheres (8) at the lower part of the string, together mixing viscous gel and solid material (7), and positioning the oil-soluble spheres (6) on upper part of the string;

c) Opening the upper ICV (2) and injecting the chemical treatment in the upper interval of the reservoir;

d) After completing the chemical treatment in the upper interval, opening the lower ICV (4) for cleaning and thus the lower interval must produce the material that is positioned inside the string, between the two intelligent completion valves;

e) Returning to the normal production condition of the well.

With the pressure drop generated by mixing oil-soluble sealing spheres (6), viscous gel and solid material (7), and water-soluble sealing spheres (8), to promote permeability reduction, the upper ICV (2) is open and the chemical treatment is injected in the upper interval.

Due to the flow passage in the plug (5) at the end of the production string (1) and through the ICV valve (4) of the lower interval, the pressure drop generated by the mixture is sufficient to carry out the divergence, with the injection of treatment into the upper ICV (2).

The objective is to temporarily plug the production string (1) in the interval between the top of the plug (5) and the base of the ICV (2), so that the chemical treatment flow can be directed to the upper interval of the well. After the treatment of the upper interval is concluded, it is opened for cleaning and thus the lower interval must produce the material that is positioned inside the string between the two intelligent completion valves (2, 4). As a result, the well returns to normal production condition.

The viscous gel is mixed with the solid material in different granulometries (example: coarse, medium and fine calcite) (7), together with the oil-soluble spheres (6) and the water-soluble spheres (8), in such a way that it can be pumped and moved to the point of interest within the production string (1), in order to generate the desired blockage between the intelligent completion valves (2, 4) or plugs (5) at the end of the string (1) with loss of tightness.

The viscous gel is cross-linked, additivated by enzymatic or peroxide breaker, to generate the divergence within the production string and direct the chemical treatment to the desired interval. These types of gels are usually made up of different polymers, such as HPG and or cellosize.

Both breakers are timed. The difference is that the enzymatic breaker is normally used in the cake of horizontal injection wells to dissolve the cake at the end of completion, thus avoiding damage to the injectivity. The peroxide type is used for gels that are injected into the reservoir, in operations that involve loss of circulation or stimulation within the reservoir. However, the peroxide after a while breaks the strength of the gel and reduces its viscosity. Thus, there is no damage to the formation due to some residual gel, because when the well is produced, the gel comes out with the same.

At the end of the operation, the method of dissolution/dispersion of the material deposited in the production string can occur as follows: in the case of cross-linked viscous gel, the peroxide or enzymatic breaker itself can be used, which will act after a determined time breaking the gel, which, from then on, starts to act like a fluid. In the case of soluble sealing spheres, the production of oil from the well itself will dissolve them. However, if necessary, an appropriate organic solvent can be used to dissolve the spheres. In the case of the solid material, an acid can be used for removal.

Since the pumping of the remote operation is carried out by means of a stimulation vessel, it is necessary to carry out an operation planning, including a risk assessment, considering the circuit passage diameters from the topside to the service and production lines in relation to the diameters of the materials that are used. The risk assessment must consider that the pumping sequence must be planned in order to avoid risks as to the displacement of materials.

It should be noted that, although the present invention has been described in relation to the attached drawings, it may undergo modifications and adaptations by technicians skilled on the subject, depending on the specific situation, but provided that it is within the inventive scope defined herein.

The invention claimed is:

1. A method of remote divergence for wells, wherein the method comprises:

with an upper inflow control valve (ICV) and a lower ICV closed, pumping oil-soluble spheres, a mixture of viscous gel and solid material in different granulometries, and water-soluble spheres, and positioning a cushion inside a production string, the cushion defining a volume equivalent to a space between a plug and a base of an intelligent completion valve of an upper interval;

filling the production string to a position above the lower ICV and below a base of the upper ICV, positioning the water-soluble spheres at a lower part of the string, together mixing viscous gel and solid material, and positioning the oil-soluble spheres on an upper part of the string;

opening the upper ICV and injecting a chemical treatment in the upper interval of a reservoir;

after completing injecting the chemical treatment in the upper interval, opening the lower ICV for cleaning, and a lower interval producing the material that is positioned inside the string, between the two intelligent completion valves; and returning to a normal production condition of a well.

2. The method according to claim 1, wherein the viscous gel is activated by an enzymatic or peroxide breaker.

3. The method according to claim 1, wherein the solid material is a mineral.

4. The method according to claim 3, wherein the mineral is a course, medium, or fine calcite.

5. The method according to claim 1, wherein the soluble spheres are of a water-soluble type.

6. The method according to claim 1, wherein the well comprises two or more ICVs installed inside the production string.

7. The method according to claim 1, wherein the well is completed with perforated casing, without intelligent completion, and produces more than one interval.

8. The method according to claim 1, wherein the soluble spheres are of an oil-soluble type.

* * * * *